United States Patent [19]

Sommer

[11] Patent Number: 4,600,368

[45] Date of Patent: Jul. 15, 1986

[54] PRESSURE ACTUATED DOWNHOLE PUMP

[75] Inventor: Gordon M. Sommer, Boca Raton, Fla.

[73] Assignee: Sommer Co., Warren, Mich.

[21] Appl. No.: 735,172

[22] Filed: May 16, 1985

[51] Int. Cl.[4] ..... F04B 47/08

[52] U.S. Cl. ..... 417/378; 417/390

[58] Field of Search ..... 417/378, 390, 383, 385, 417/386, 388

[56] References Cited

U.S. PATENT DOCUMENTS

| | | | |
|---|---|---|---|
| 2,014,613 | 9/1935 | Ceverha | 417/383 |
| 2,355,618 | 8/1944 | Bodine . | |
| 2,376,538 | 5/1945 | Hardey | 417/383 |
| 2,379,539 | 7/1945 | Mercier . | |
| 2,428,460 | 10/1947 | Inglis . | |
| 2,572,977 | 10/1951 | Bodine . | |
| 2,751,848 | 6/1956 | Smith . | |
| 3,123,007 | 3/1964 | Orr | 417/390 |
| 3,161,139 | 12/1964 | Borelli | 417/385 X |
| 4,295,799 | 10/1981 | Bentley | 417/240 |
| 4,341,505 | 7/1982 | Bentley | 417/240 |

*Primary Examiner*—Leonard E. Smith

*Attorney, Agent, or Firm*—Harness, Dickey & Pierce

[57] ABSTRACT

The downhole pumping member is reciprocated upwardly by pressurizing the column of oil using an above ground pressure actuator. When this occurs, the pumping member draws a charge of oil from the well. Next the column of oil is depressurized, allowing the pumping member to fall under gravity, which in turn forces the charge of oil upwardly toward the surface. The above ground actuator is hydraulically operated using a hydraulic fluid which is maintained separated from the production oil being pumped.

7 Claims, 7 Drawing Figures

PRESSURE ACTUATED DOWNHOLE PUMP

BACKGROUND AND SUMMARY OF THE INVENTION

This invention relates generally to downhole pumps for extracting subterranean production fluids, such as crude oil, water or the like. More specifically, the invention relates to a downhole pump having a submersible downhole reciprocating pump member which is driven alternately up and down under fluid pressures generated by a surface located actuator and by gravitational forces, respectively. Through such reciprocation, the pumping member draws production fluid from the well during each upstroke and pumps such fluid toward the surface with each downstroke.

It is a common site across this country's oil fields to see so-called "walking beam pumps" slowly rocking up and down to extract oil from beneath the ground. According to conventional practice, these walking beam pumps employ lengthy jointed rods, known as sucker rods, for connecting the pump plunger in the well with the walking beam or pumping jack at the surface. In many instances these sucker rods may be hundreds or thousands of feet long. It is therefore not surprising that the initial costs and maintenance costs of walking beam systems are quite high.

There have been attempts at overcoming the shortcomings of walking beam pumps but those attempts have been largely unsuccessful. One attempt has been to position a downhole pumping device at the bottom of the well and to place an impacting device at the top of the well. The downhole pumping device usually includes a plunger which is biased upward by spring mechanisms and has a passage formed axially therethrough with a one way check valve located in the passage. The impacting device is repeatedly energized, causing sonic impulses to travel down the well hole to strike the plunger. Theoretically, each time the sonic impulse strikes the plunger it moves the plunger downwardly against spring bias, and the check valve opens to admit the fluid being pumped into the passage. Each subsequent spring biased upstroke of the plunger closes the check valve and causes a general upward movement of the liquid column with the uppermost portion thereof discharging through a delivery port.

While interesting in theory, the prior art sonic impulse pumping systems have not proven to be generally effective and reliable. Hence, oil production companies to this day still rely upon walking beam pumping technology.

It is therefore an object of this invention to overcome the shortcomings and expense of walking beam pumps. It is another object of the invention to advantageously utilize gravitational forces in pumping subterranean production fluids. Yet another object of the invention is to provide a pumping system which uses comparatively inexpensive and maintenance free components, particularly in the downhole components where routine access, inspection and maintenance is difficult to effect.

Therefore, to fulfill these and other objectives, as will become apparent from a reading of the following specification, the invention provides a downhole pump for pumping a production fluid from a well hole. The invention comprises a collection means communicating with the well hole for receiving the production fluid as it is pumped. A downhole pumping means is disposed within the well hole for generally vertical reciprocation therein and operable upon such reciprocation, to draw the production fluid from the well on each upstroke thereof, and to pump or expel the production fluid upwardly toward the collection means on each downstroke thereof. The invention further comprises an actuating means for causing the reciprocation of the pumping means comprising a gravitational means for urging the pumping means in the downstroke direction and a fluid pressure means for urging the pumping means in the upstroke direction.

Further, in accordance with the invention, the actuating means comprises an actuating cylinder and a piston reciprocable within the cylinder. The piston defines within the cylinder a first fluid chamber and a second fluid chamber, the second chamber being coupled to communicate with the well hole and to receive the production fluid. A supply of hydraulic fluid, maintained separate from the production fluid is at least partially contained within the first fluid chamber. A pressure generating means communicates with the first fluid chamber for cyclically altering the pressure of the hydraulic fluid within the first fluid chamber between a high pressure state and a low pressure state. The piston is responsive to the high and low pressure states within the first chamber to subject the production fluid within the well to corresponding high and low pressure states. The pumping means is responsive to the high pressure state of the production fluid within the well to overcome gravitational forces and thereby effect the upstroke or fluid drawing stroke. The pumping means is permitted, during each subsequent low pressure state to effect the downstroke or pumping stroke in response to gravitational forces.

Thus, it will be seen that the present invention uses gravity to pump production fluids up to the surface of the ground, and uses hydrostatic pressures, generated at the surface, to raise the reciprocating pump, thereby drawing a charge of fluid from the well for the next pumping cycle. The invention provides a marked improvement in pumping efficiency through this advantageous use of gravitational forces. Moreover, the downhole pumping mechanism is virtually foolproof with no springs to wear out and replace. Also, the above surface actuator uses a supply of hydraulic fluid which is contained completely separate from the production fluid being pumped. As production fluids, such as crude oil, are often laden with mineral deposits, dirt and sludge, the invention's use of a separate clean hydraulic fluid contributes to overall efficiency and low maintenance, and permits the use of lower horse power, commercially available and inexpensive pressure pumps.

For a more complete understanding of the invention, its objects and advantages, reference may be had to the following specification and to the accompanying drawings.

DESCRIPTION OF THE PREFERRED EMBODIMENT

Figure 1:
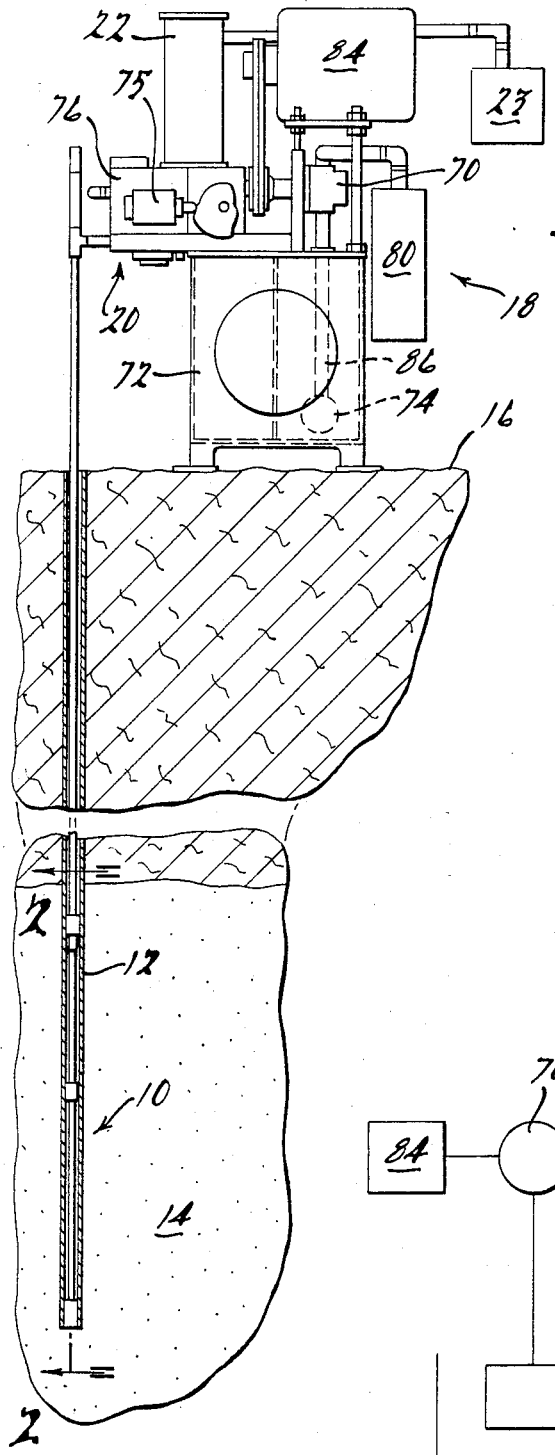
FIG. 1 is a diagrammatic side view of the overall pumping system of the invention showing the earth in cross-section.

With reference to FIG. 1, the present invention comprises a downhole pumping member 10, which is disposed within the production tubing 12 of a well hole system. As illustrated pumping member 10 resides at the lowermost end of production tubing 12, where it may have access to the subterranean production fluid, such as oil, indicated generally at 14.

In FIG. 1 the surface of the earth is indicated generally at 16. Disposed above or upon the surface of the earth is the control unit 18 which comprises generally a fluid pressure sending unit 20 and a production fluid collection means 22 which may be adapted to communicate with a production fluid pipeline, collection tank, or the like, indicated diagrammatically at 23.

The details of each of the above components are discussed below. As a brief overview of the invention, the downhole pumping member 10 is reciprocable within the production tubing 12. On each upstroke thereof, pumping member 10 draws a charge of production fluid from the well; and on each downstroke thereof, pumping member 10 expels its charge of production fluid upwardly through tubing 12. After successive reciprocation cycles, the charge of fluid is finally raised to the surface of the earth and discharged into production fluid collection means 22. It is important in understanding the invention to keep in mind that the pumping member 10 draws fluid from the well on the upstroke and pumps or expels fluid upwardly on the downstroke.

To effect this reciprocation of the pumping member 10, control unit 18 periodically pressurizes the column of production fluid in tubing 12. Due to the particular construction of pumping member 10, which will be explained below, each periodic increase in fluid column pressure causes a portion of pumping member 10 to rise on the upstroke. As fluid column pressure is decreased (between pressurizing cycles) the reciprocating portion of pumping member 10 is urged on its downstroke by gravitational forces. Thus the invention enjoys the advantage of having its control unit disposed above ground for easy maintenance and also advantageously uses gravitational forces to pump production fluid to the surface.

Figure 2:
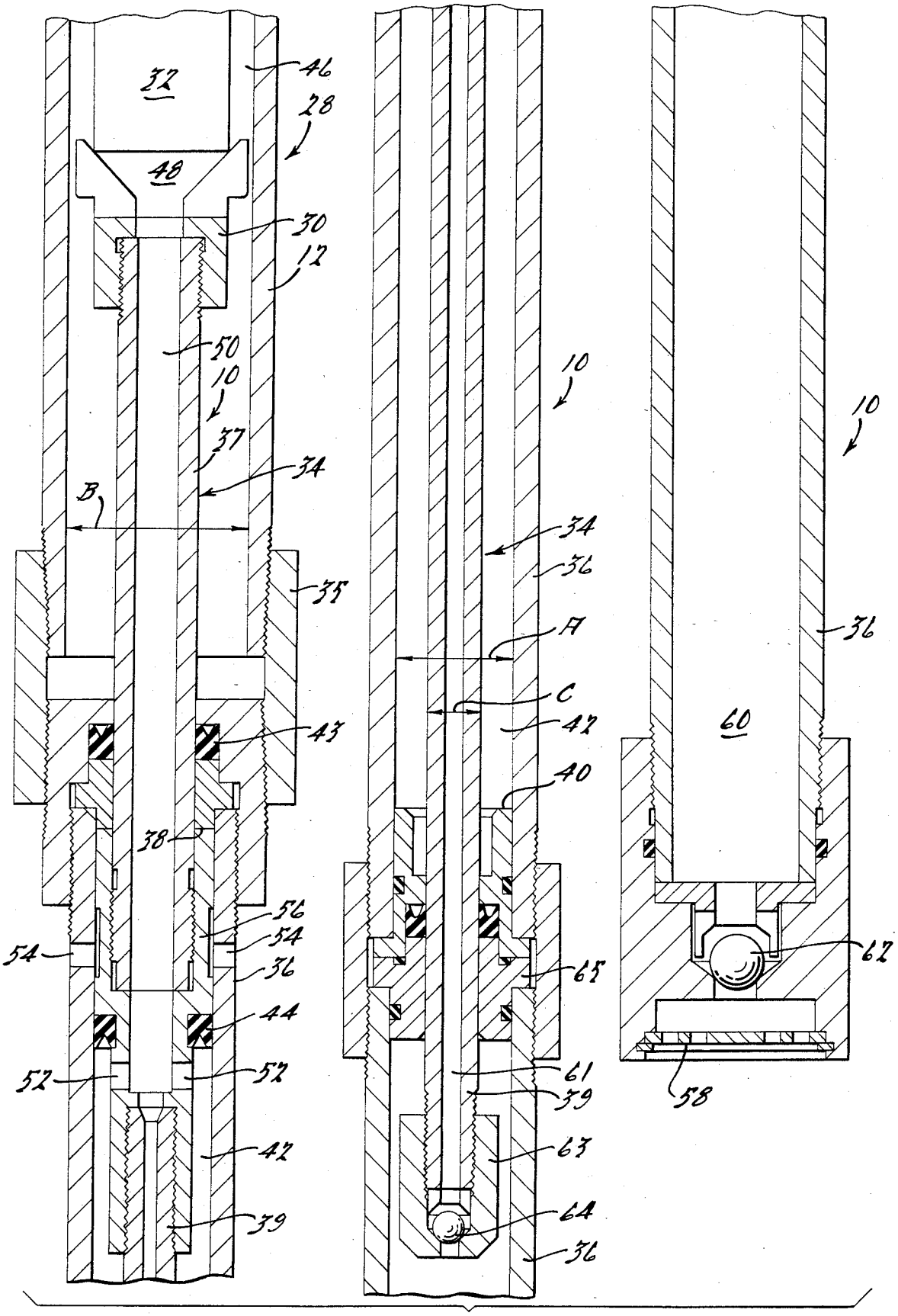
FIG. 2 is a longitudinal cross-sectional view through the lowermost end of the well hole, illustrating the downhole pumping member in detail.

With this overview in mind, reference may now be had to FIG. 2 which illustrates the downhole pumping member 10 coupled to production tubing 12 by coupler 24. It will be understood that production tubing 12, and thus downhole pumping member 10, are disposed within a well hole, such as well hole 26 shown in FIG. 1.

Downhole pumping member 10 is illustrated in FIG. 2 in the up position, that is, at the end of the upstroke. Pumping member 10 includes an upper end 28 to which a reciprocation guide end cap 30 is attached. In use, upper end 28 reciprocates upwardly and downwardly within the lowermost end of production tubing 12 and end cap 30 acts to center upper end 28 during reciprocation. Resting directly upon end cap 30 is a weight 32 which may be any convenient elongated, preferably cylindrical, mass such as old sucker rods, or the like. Weight 32 provides the downward biasing force which causes the downstroke of pumping member 10 and thereby raises the production fluid to the surface. Accordingly, the size of weight 32 will depend upon the depth of the well, i.e. the heighth to which the production fluid must be raised in order to reach the production fluid collection means 22. In deep wells on the order of 8,000 feet, weight 32 must be approximately 7,000 pounds.

Downhole pumping member 10 comprises an elongated and generally cylindrical hollow piston 34 disposed within a similarly elongated pumping cylinder 36. Cylinder 36, which may be comprised of several joined sections, is secured to the end of production tubing 12 with threaded collar 35. Piston 34 is reciprocable within cylinder 36 between upper limit 38 and lower limit 40. Piston 34 is illustrated at its upper limit 38 (full upstroke) in FIG. 2. As illustrated, piston 34 comprises an upper tube 37 and a lower tube 39 joined by collar 56. Piston 34 has an outer diameter C which is a predetermined size smaller than the inner diameter A of pumping cylinder 36. The inner diameter A of cylinder 36 is in turn a predetermined size smaller than the internal diameter B of production tubing 12. An annular space 42 is defined between the outer diameter of piston 34 and the inner diameter of cylinder 36. Oil seals 43 and 44 are provided on piston 34 to provide a tight fluid seal between the piston and cylinder walls. A second annular space 46 is defined between the outer diameter of weight 32 and the inner diameter B of production tubing 12, through which fluid pressures may be introduced into the open center 48 of end cap 30 and thence into the central passage 50 of piston 34. Piston 34 is provided with a port 52 adjacent oil seal 44. Oil pressures introduced through central passage 50 are communicated through port 52 into annular space 42. Fluid pressures so introduced through port 52 increase the pressure within annular space 42, causing pressure differentials to act upon oil seal 44 and to thereby raise piston 34 on the upstroke. Another port 54 is also provided through the wall of pumping cylinder 36 for the expulsion of oil during the upstroke.

In order to effect the desired pumping action, the relative sizes of diameters A,B and C must be selected. These diameters must also be selected in accordance with the mass or weight of weight 32, which in turn depends upon factors such as the depth of the well hole and the viscosity of the production fluid to be pumped. The relationship among these variables (diameters, weight, well depth, viscosity, etc.) may be expressed by tthe computer program written in BASIC and attached and incorporated herein as Appendix A. Also included with the program in Appendix A are three examples, giving the computer program outputs for depths of one thousand feed, two thousand feet and three thousand feet, respectively.

At the lowermost end of pumping cylinder 36 an inlet screen 58 is provided for straining the incoming production fluid before it enters check valve 62. As illustrated, check valve 62 is threadedly attached to the lowermost end of pumping cylinder 36 and is arranged to permit fluid flow into the holding chamber 60 of cylinder 36 and to prevent expulsion of fluid from chamber 60 back into the well through screen 58. A second check valve 64 is threadedly secured to the lowermost end of hollow piston 34. This check valve is disposed to permit the inflow of fluid from chamber 60 into fluid passage 61 and to prevent the outflow of fluid from passage 61 into chamber 60. The valve body 63 is preferably sized to act as a plunger reciprocable within chamber 60 to pump fluids from chamber 60 into passage 61 on the downstroke. As seen in the centermost section of FIG. 2, lower tube 39 of piston 34 is slidably captured to seal and guide assembly 65. Assembly 65 is provided with a plurality of oil seals in order to isolate chamber 60 from annular space 42. This prevents loss of upstroke driving pressures into the holding chamber 60.

Figure 3:
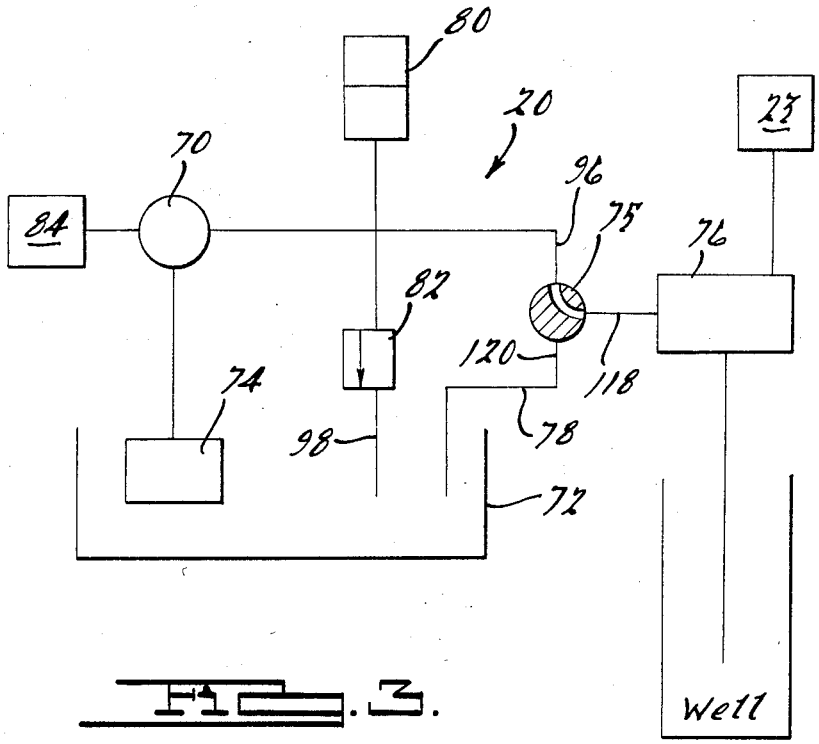
FIG. 3 is a schematic block diagram illustrating the above-ground pressure actuating system of the invention.

Referring now to FIG. 3, the fluid circuit of fluid pressure sending unit 20 is shown schematically. The fluid circuit includes pump 70 for pumping hydraulic oil from a storage reservoir 72 via strainer 74. Pump 70 delivers hydraulic oil under pressure through valve 75 to actuator 76, which will be described in more complete detail below. Valve 75 also couples to return line 78, which discharges hydraulic oil back into storage reservoir 72. Valve 75 is operable between two positions, a first position (shown in FIG. 3) which sends hydraulic fluid under pressure to actuator 76, and a second position which receives hydraulic fluid from actuator 76 for discharging into reservoir 72. Valve 75 is a cam actuated valve and is described more fully below. The fluid circuit also includes an accumulator 80 and relief valve 82, both coupled to the output of pump 70. As illustrated, pump 70 is driven by a motor 84.

Figure 4:
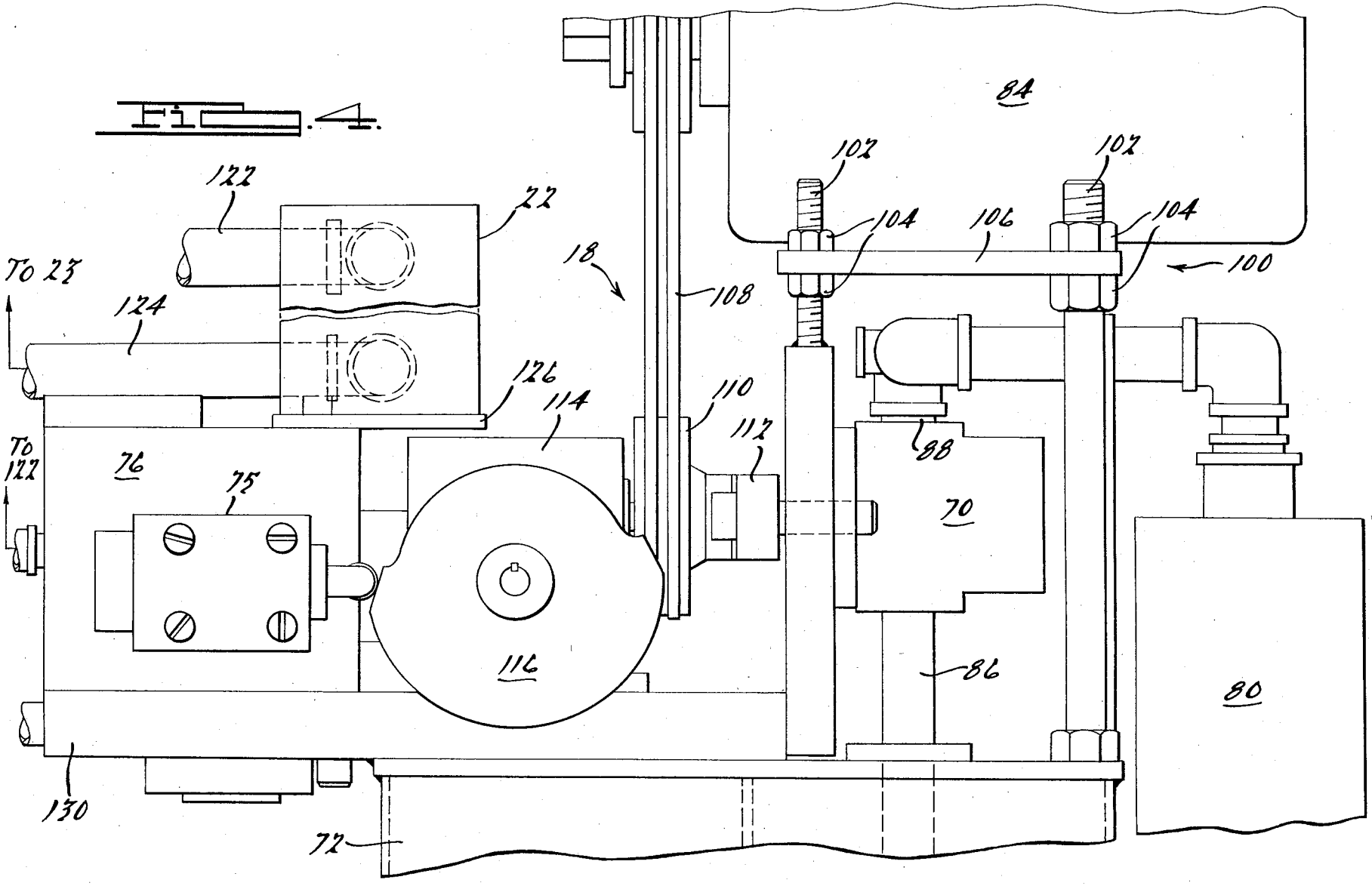
FIG. 4 is a front view of the above-ground actuator mechanism and hydraulic fluid storage system of the invention.
Figure 5:
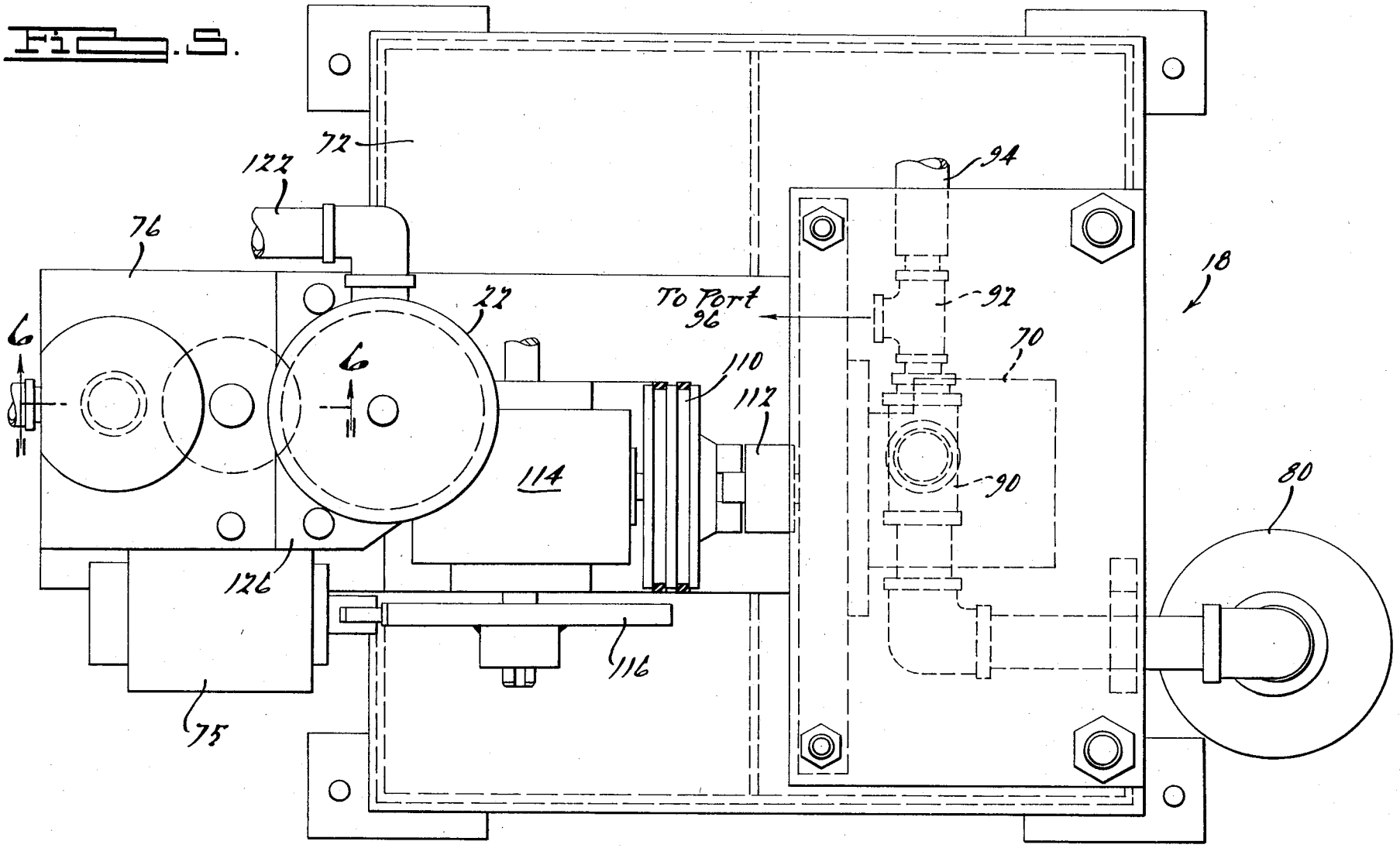
FIG. 5 is a plan view of the actuator mechanism of FIG. 4.

With the foregoing schematic fluid circuit in mind, reference may now be had to FIGS. 4 through 7, which illustrate the above-ground control unit 18 in greater detail. Referring first to FIGS. 4 and 5, control unit 18 comprises storage reservoir 72 upon which the remainder of the control unit is mounted. In the presently preferred embodiment, storage reservoir 72 is a generally rectangular tank, of approximately 10 gallon capacity. Disposed within and near the bottom of storage reservoir 72 is strainer 74 (see FIG. 1). Strainer 74 is coupled through supply pipe 86 to the inlet of pump 70, which is mounted above the reservoir generally as shown. Pump 70 delivers hydraulic oil under pressure through pump outlet 88 into T fitting 90, which feeds accumulator 80 and also feeds a second T fitting 92. Second T fitting 92, in turn, feeds pressure relief valve 94 and also feeds the pressure inlet port 96 of valve 75. Pressure relief valve 94 discharges through relief pipe 98 (FIG. 3) into storage reservoir 72.

To provide motive power to oil pump 70 an electric motor 84 is provided. Motor 84 is mounted on adjustable mounting bracket 100 which comprises a pair of elongated bolt structures 102, each bolt structure carrying a pair of nuts 104 supporting a mounting plate 106. Nuts 104 may be adjusted upwardly and downwardly to adjust the position of mounting plate 106 and thereby adjust the proper motor drive belt tension.

Motor 84 is coupled to oil pump 70 using a conventional V-belt 108 to drive pulley 110 and gear reducer 112. Motor 84 is preferably a 3 horsepower, 17,500 rpm electric motor. Gear reducer 112 may be implemented using a Browning model No. CHIP3. In addition to driving oil pump 70, motor 84 also supplies motive power to the cam operated valve 75. As best seen in FIG. 4, motive power is taken from pulley 110 to a worm drive gear box 114. Gear box 114 drives cam 116, which is fashioned generally as shown in FIG. 4. In the presently preferred embodiment, gear box 114 is implemented using a Browning No. 133VI-LR30E. Cam 116 actuates valve 75 to operate between a first position, wherein pressure inlet port 96 (from oil pump 70) is coupled to pressure outlet port 118, and a second position, wherein exhaust port 120 (to reservoir (72) is coupled to pressure outlet port 118 (see FIG. 3). In the presently preferred embodiment valve 75 may be implemented using a Parker No. D3DHB valve. While a cam actuated valve is presently preferred, the invention may be implemented using an electrically actuated valve in conjunction with an electronic timer circuit for cyclically generating electrical impulses for driving the cam between its respective first and second positions. With reference to the configuration of cam 116, it will be seen that cam 116 cycles valve 75 between the respective first and second positions for approximately equal intervals. More precisely, in the presently preferred embodiment cam 117 is in the first position for approximately 170 degrees and in the second position for approximately 130 degrees and in transition for the remainder. Preferably cam 117 cycles valve 75 to effect 60 strokes per minute. It will, of course, be recognized that the invention may be operated at other cycle rates without departing from the spirit of the invention.

Control unit 18 further comprises a production fluid collection means 22, which takes the form of a generally cylindrical upstanding cylinder having an inlet coupling 122 for connection to receive production fluid from actuator 76, and further having an outlet coupling 124 for connection to a production fluid collection tank or pipeline system 23. Fluid collection means 22 is mounted using a flanged mounting bracket 126 to the body of actuator 76. As will become more apparent from a closer study of FIGS. 3 and 4 and from the further description which follows, many of the components which comprise control unit 18 are assembled on the body of actuator 76. This arrangement affords a particularly compact, economically produced and easily serviced control unit. If, for example, the control unit were to require servicing, the entire unit can be dismounted from the storage reservoir 72 and taken into a repair shop for overhaul. The control unit 18 is quite compact, as will be appreciated by comparing its size with the 10 gallon storage reservoir upon which it is mounted. Thus the present invention provides a readily transportable and unobtrusive pumping apparatus which minimizes the size of real estate easements and completely eliminates unsightly above-ground walking beams.

Figures 6, 7:
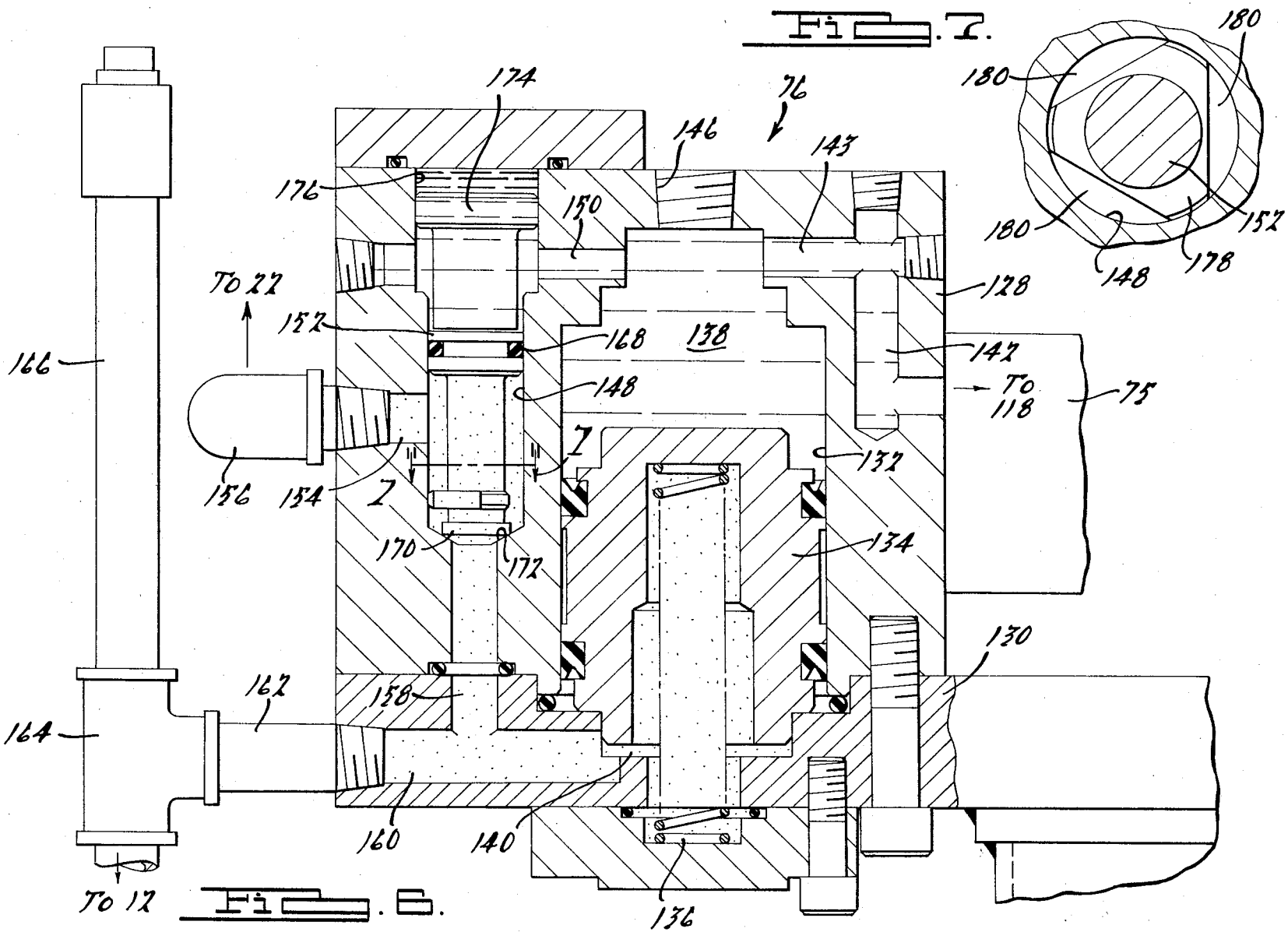
FIG. 6 is a cross-sectional view taken substantially along the line 6—6 of FIG. 4, illustrating the actuator in greater detail.
FIG. 7 is a detailed cross-sectional view of the actuator valve spool taken substantially along the line 7—7 of FIG. 6.

Referring now to FIG. 6, actuator 76 will be discussed in detail. Actuator 76 comprises a body or manifold block 128 which is bolted to mounting plate 130. Mounting plate 130 and manifold block 128 are also shown in FIG. 4. Manifold block 128 defines a first cylinder or bore 132 in which a piston 134 reciprocates. Piston 134 is biased by spring 136, which urges piston 134 in a generally upward direction. Piston 134 divides cylinder 132 into a first cavity 138 and a second cavity 140. Cavity 138 is filled with hydraulic oil from storage reservoir 72, while second cavity 140 is filled with production fluid. Piston 134 is operable between a depressurized first position, wherein spring 136 urges piston 134 to its upward limit, and a pressurized second position, wherein piston 134 is driven to its lower limit against spring bias force by fluid pressures within first cavity 138. Piston 134 is shown in its second or pressurized position in FIG. 6. Manifold block 128 also includes bores 142 and 143 which communicate between first cavity 138 and the pressure outlet port 118 of cam operated valve 75. A plug-filled aperture 146 also communicates with first cavity 138 to provide access to cavity 138 for priming and for relieving back pressures when removing piston 134 for servicing.

Cavity 138 communicates with a second bore or cylinder 148 via passage 150. Second cylinder 148 contains pressure actuated valve spool 152. Cylinder 148 communicates through outlet passage 154 and through pipe 156 to the production fluid collection means 22. Cylinder 148 also communicates through passage 158 and through production oil passage 160 with the second cavity 140 of first cylinder 132. Production oil passage 160 also communicates with outlet 162 which connects to the downhole pump via fitting 164 and production tubing 12. Preferably, fitting 164 is provided with an upstanding end-capped pipe section 166 which may be uncapped in order to prime the downhole pump by filling production tubing 12 with oil or other suitable fluid. After priming, pipe section 166 is capped during pumping.

Valve spool 152 includes O-ring seal 168 which serves as a means for preventing the hydraulic working oil from becoming mixed with the production fluid. By segregating the hydraulic working oil from the production fluid, the invention is capable of efficient pumping using a comparatively light duty, commercially available pump 70. The construction of actuator 76 prevents the hydraulic working oil and the production fluid from becoming mixed together, and yet permits the transfer of fluid pressures between the working oil and production fluid.

Spool 152 includes a valve end portion 170 which seats in valve seat 172 when the spool is at its downwardmost position as shown in FIG. 6. When seated, the valve end portion 170 prevents pressures transferred from piston 134 from escaping into the production fluid collection means 22. Spool 152 includes a plunger end 174 opposite valve end portion 170. Plunger 174 is reciprocable within chamber 176. With reference to FIG. 7, it will be seen that spool 152 includes a lower guide member 78 which has a plurality of cutouts or apertures 180 which permit passage of production fluid when the valve is unseated. Valve spool 152 is actuated by fluid pressures to cyclically open and close to the passage of production fluid from the well into the fluid collection means. Spool 152 is driven downwardly each time first cavity 138 is pressurized under control of cam operated valve 75. Spool 152 is driven upwardly due to fluid pressures caused by the upwardly pumped production oil.

In operation, motor 84 is energized causing pump 70 to pump hydraulic oil from storage reservoir 72 under pressure to cam actuated valve 75. Motive power derived from motor 84 drives cam 116 by means of worm gear box 114, and cam 116 in turn cycles valve 75 between its respective first and second positions. Valve 75 spends approximately equal times in both first and second positions (preferably about 170 degrees in the first position and about 130 degrees in the second position).

When valve 75 is in the first position, pressurized hydraulic oil is introduced into cavity 138 of actuator 76. The introduction of hydraulic oil increases the pressure within cavity 138 and also within cylinder 148, causing both the piston 134 and the valve spool 152 to move downwardly to the positions shown in FIG. 6. Downward movement of valve spool 152 caused valve end portion 170 to seat within valve seat 172, thereby sealing off production oil passage 160 from the production fluid collection means 22. Downward movement of piston 134 causes or transfers a pressure increase in the production fluid contained within passage 160. This pressure increase is coupled through the column of production fluid within production tubing 12 to the downhole pumping member 10.

The rise in production fluid pressure in the downhole production tubing causes a corresponding fluid pressure increase within the central passage 50 of hollow piston 34 of the downhole pumping member 10. This increase in pressure is transferred through port 52 to cause a corresponding pressure increase within the annular space 42 of pumping member 10. The pressure increase within annular space 42 urges piston 34 upwardly, lifting weight 32 in the process. When piston 34 reaches upper limit 38 further upward movement is checked. During such upward piston movement, production fluid is ejected through port 54 until port 54 is blocked by collar 56. The expulsion of oil through port 54 permits piston 34 to rise more rapidly for the majority of its upstroke. The blocking of port 54 by collar 56 at the end of the upstroke causes the remaining oil trapped between collar 56 and upper limit 38 to become compressed, thereby serving as a cushion or shock absorber. Upward movement of piston 34 also draws a charge of production fluid through screen 58, past check valve 62 and into holding chamber 60. Check valve 64 prevents the charge of fluid from ejecting through passage 61.

When Cam actuated valve 75 is moved to its second position under control of cam 116, fluid pressure from pump 70 is prevented from entering the inlet of actuator 76. With pumping pressure removed, spring 136 drives piston 134 upwardly. At the same time, valve 75 connects the actuator port 118 to the return line 78 to permit hydraulic oil to discharge back into storage reservoir 72. With pressures within cavity 138 relieved, spool 152 is free to rise under the pressure of incoming production fluids. Accordingly, the spool will rise to a position which permits production fluid to flow upwardly from production tubing 12, through passages 158 and 154 and into pipe 156. From there the production fluid flows into collection means 22 and thence to the oil tank or pipeline system 123

APPENDIX A

```
90 CLS
100 PRINT "LOW VOLUME PUMP CALCULATIONS"
110 PRINT "15 BARRELS/DAY - MAX 3000 FT"
120 PRINT "                                        "
125 PRINT "RECYCLES UNTIL 0 ENTER FOR DEPTH"
130 INPUT "DIA A (in)";A
135 INPUT "DIA B (in)";B
140 INPUT "DIA C (in)";C
160 PRINT "DEGREES OF API VISCOSITY"
165 INPUT "(28 IS STANDARD)";V
170 INPUT "DEPTH IN THOUSAND FEET";H
175 IF H=0 THEN END ELSE 180
180 INPUT "INCREMENTAL WEIGHT (LBS)";IW
190 INPUT "INCREMENTAL PSI";IP
200 P%=H*141.5/(131.5+V)*433.194
205 PRINT "PRESSURE DUE TO DEPTH=";P%
210 W%=P%*.7854*(B¢2-A¢2)
220 TW%=W%+IW
230 PRINT "TOTAL WEIGHT IN FLUID=";TW%
240 PRINT "DOWN FORCE = INCREMENTAL WEIGHT"
250 UF = (P% + IP) * .7854 * ((B¢2-C¢2)-A¢2) - TW%
260 PRINT "UP FORCE MUST BE POSITIVE"
270 PRINT "ACTUAL FORCE=";UF
280 IF UF§0 THEN 190 ELSE 290
```

APPENDIX A-continued

```
290 INPUT "CYCLES/MIN";CM
300 CI = 15 * 42 * 231 / (24*60*CM)
310 S! = CI / (.7854 * C¢2)
320 PRINT "STROKE LENGTH=";S!
330 GM! = CM * .7854 * S! * ((B¢2-C¢2)-A¢2) /231
332 DP = S! * .7854 * (B¢2-C¢2-A¢2)
335 PRINT "SURFACE PUMP DISPL./CYCLE=";DP
340 PRINT "GPM OF SURFACE PUMP=";GM
350 HP = GM! * IP / 1714
360 PRINT "THEORETICAL HP=";HP
370 GOTO 170
RUN
LOW VOLUME PUMP CALCULATIONS
15 BARRELS/DAY - MAX 3000 FT
RECYCLES UNTIL 0 ENTER FOR DEPTH
DIA A (in)? .875
DIA B (in)? 1.25
DIA C (in)? .5
DEGREES OF API VISCOSITY
(28 IS STANDARD)? 28
DEPTH IN THOUSAND FEET? 1
INCREMENTAL WEIGHT (LBS) ? 150
INCREMENTAL PSI ? 850
PRESSURE DUE TO DEPTH=384
TOTAL WEIGHT IN FLUID=390
DOWN FORCE = INCREMENTAL WEIGHT
UP FORCE MUST BE POSITIVE
ACTUAL FORCE=140.0222
CYCLES/MIN? 60
STROKE LENGTH=8.578432
SURFACE PUMP DISPL./CYCLE=3.68457
GPM OF SURFACE PUMP=.9570311
THEORETICAL HP=.474607
DEPTH IN THOUSAND FEET? 0
Ok
RUN
LOW VOLUME PUMP CALCULATIONS
15 BARRELS/DAY - MAX 3000 FT
RECYCLES UNTIL 0 ENTER FOR DEPTH
DIA A (in)? .875
DIA B (in)? 1.25
DIA C (in)? .5
DEGREES OF API VISCOSITY
(28 IS STANDARD)? 28
DEPTH IN THOUSAND FEET? 2
INCREMENTAL WEIGHT (LBS) ? 150
INCREMENTAL PSI ? 1050
PRESSURE DUE TO DEPTH=769
TOTAL WEIGHT IN FLUID=631
DOWN FORCE = INCREMENTAL WEIGHT
UP FORCE MUST BE POSITIVE
ACTUAL FORCE=150.2888
CYCLES/MIN? 60
STROKE LENGTH=8.578432
SURFACE PUMP DISPL./CYCLE=3.68457
GPM OF SURFACE PUMP=.9570311
THEORETICAL HP=.5862793
DEPTH IN THOUSAND FEET? 0
Ok
RUN
LOW VOLUME PUMP CALCULATIONS
15 BARRELS/DAY - MAX 3000 FT
RECYCLES UNTIL 0 ENTER FOR DEPTH
DIA A (in)? .875
DIA B (in)? 1.25
DIA C (in)? .5
DEGREES OF API VISCOSITY
(28 IS STANDARD)? 28
DEPTH IN THOUSAND FEET? 3
INCREMENTAL WEIGHT (LBS) ? 150
INCREMENTAL PSI ? 1200
PRESSURE DUE TO DEPTH=1153
TOTAL WEIGHT IN FLUID=872
DOWN FORCE = INCREMENTAL WEIGHT
UP FORCE MUST BE POSITIVE
ACTUAL FORCE=138.65
CYCLES/MIN? 60
STROKE LENGTH=8.578432
SURFACE PUMP DISPL./CYCLE=3.68457
GPM OF SURFACE PUMP=.9570311
THEORETICAL HP=.6700334
```

APPENDIX A-continued

```
DEPTH IN THOUSAND FEET? 0
Ok
```

What is claimed is:

1. A downhole pump for pumping a production fluid from a well hole comprising:

collection means communicating with said well hole for receiving said production fluid as it is pumped;

a downhole pumping means disposed within said well hole for generally vertical reciprocation therein and operable under reciprocation to draw said production fluid from said well on the upstroke thereof and to expel said production fluid into said collection means on the downstroke thereof;

actuating means for causing said reciprocation of said pumping means by cyclically pressurizing said production fluid comprising an actuating cylinder disposed above said well hole and a piston reciprocable within said cylinder, said piston defining within said actuating cylinder a first fluid chamber and a second fluid chamber, said second chamber being coupled to communicate with said well hole and receptive of said production fluid;

said actuating means further comprising a second cylinder disposed above said well hole and a valve spool reciprocable within said second cylinder, said spool defining within said second cylinder a third fluid chamber and a fourth fluid chamber, said third chamber being coupled to communicate with said first chamber and said fourth chamber being coupled to communicate with said second chamber and with said collection means and being receptive of said production fluid;

said spool having a sealing means for substantially preventing fluid communication between said third and fourth chambers;

said spool being responsive to pressures within said third and fourth chambers to reciprocate between a first position in which fluid communicating between said fourth chamber and said collection means is established and a second position in which fluid communicating between said fourth chamber and said collection means is impeded;

a supply of hydraulic fluid maintained separate from said production fluid by said sealing means and maintained entirely externally from said well hole and at least partially contained within said first and third fluid chambers; and pressure generating means communicating with said first fluid chamber for cyclically altering the pressure of said hydraulic fluid within said first fluid chamber between a high pressure state and a low pressure state;

wherein said piston is responsive to said high and low pressure states within said first chamber to subject said production fluid within said well hole to corresponding high and low pressure states;

wherein said pumping means is responsive to said high pressure state of said production fluid within said well hole to overcome gravitational forces and to effect said upstroke and wherein said spool is concurrently urged to said second position in response to said high pressure state within said first chamber; and wherein said pumping means is permitted during said low pressure state of said production fluid within said well hole to effect said downstroke in response to gravitational forces and wherein said spool is concurrently urged to said first position to permit said production fluid to be expelled to said collection means.

2. A downhole pump for pumping a production fluid from a well hole comprising:

collection means communicating with said well hole for receiving said production fluid as it is pumped;

a downhole pumping means disposed within said well hole for generally vertical reciprocation therein and operable upon reciprocation to draw said production fluid from said well on the upstroke thereof and to expel said production fluid into said collection means on the downstroke thereof;

actuating means for causing said reciprocation of said pumping means by cyclically pressurizing said production fluid to cause said upstroke comprising an actuating cylinder disposed above said well hole and a piston reciprocable within said cylinder, said piston defining within said actuating cylinder a first fluid chamber and a second fluid chamber, said second chamber being coupled to communicate with said well hole and receptive of said production fluid;

a supply of hydraulic fluid maintained separate from said production fluid and maintained entirely externally from said well hole and at least partially contained within said first fluid chamber; and pressure generating means communicating with said first fluid chamber for cyclically altering the pressure of said hydraulic fluid within said first fluid chamber between a high pressure state and a low pressure state;

wherein said piston is responsive to said high and low pressure states within said first chamber to subject said production fluid within said second chamber and within said well hole to corresponding high and low pressure states;

wherein said pumping means is responsive to said high pressure state of said production fluid within said well hole to overcome gravitational forces and to effect said upstroke; and wherein said pumping means is permitted during said low pressure state of said production fluid within said well hole to effect said downstroke in response to gravitational forces.

3. The pump of claim 2 wherein said actuating means further comprises spring means for biasing said piston in a first direction and wherein said piston is responsive to said high pressure state within said first chamber to move in a second direction.

4. The pump of claim 2 wherein said pressure generating means includes hydraulic pump for delivering said hydraulic fluid to said actuating cylinder under pressure and means for cyclically interrupting said delivery.

5. The pump of claim 4 wherein said pressure generating means further includes a storage reservoir and valve means operable between first valve position wherein said pressurized hydraulic fluid is delivered to said actuating cylinder and a second valve position wherein said hydraulic fluid within said first fluid chamber is at least partially expelled into said storage reservoir.

6. The pump of claim 5 further comprising switching means for alternately switching said valve means from said first position to said second position.

7. The pump of claim 6 wherein said switching means comprises cam means.

* * * * *

UNITED STATES PATENT AND TRADEMARK OFFICE

CERTIFICATE OF CORRECTION

PATENT NO. : 4,600,368

DATED : July 15, 1986

INVENTOR(S) : Gordon M. Sommer

It is certified that error appears in the above-identified patent and that said Letters Patent is hereby corrected as shown below:

| | |
|---|---|
| Col. 4, line 11, | "heighth should be --heigth--. |
| Col. 4, line 25, | the word "together" is missing between the words "joined" "by". |
| Col. 4, line 57, | "tthe" should be "the". |
| Col. 4, line 61, | "feed" should be --feet--. |
| Col. 5, line 11, | "to" should be "by". |
| Col. 5, line 46, | "pipe" is missing between words "outlet" and "88". |
| Col. 7, line 44, | "78" should be --178--". |
| Col. 8, line 46, | there is no period after "123". |
| Col. 8, line 52, | there are blanks between quotes instead of "=" signs. |
| Col. 9, line 9, | there is no "!" after "GM". |

Signed and Sealed this

Eighth Day of December, 1987

*Attest:*

DONALD J. QUIGG

*Attesting Officer*

*Commissioner of Patents and Trademarks*